US007121528B2

(12) United States Patent
Mikkelsen

(10) Patent No.: US 7,121,528 B2
(45) Date of Patent: Oct. 17, 2006

(54) TOOL FOR USE WHEN LAYING DOWN FLOOR ELEMENTS WITH TONGUE AND GROOVE JOINTS

(75) Inventor: Gert Bjerring Mikkelsen, Galten (DK)

(73) Assignee: Itools APS, Nordborg (DK)

( * ) Notice: Subject to any disclaimer, the term of this patent is extended or adjusted under 35 U.S.C. 154(b) by 0 days.

(21) Appl. No.: 10/507,099

(22) PCT Filed: Mar. 13, 2003

(86) PCT No.: PCT/DK03/00162

§ 371 (c)(1),
(2), (4) Date: Mar. 17, 2005

(87) PCT Pub. No.: WO03/076740

PCT Pub. Date: Sep. 18, 2003

(65) Prior Publication Data

US 2005/0155204 A1 Jul. 21, 2005

(30) Foreign Application Priority Data

Mar. 14, 2002 (DK) ..... 2002 00390

(51) Int. Cl.
*B66F 3/00* (2006.01)

(52) U.S. Cl. ..... 254/11; 254/131

(58) Field of Classification Search ..... 254/11, 254/131, 131.5; 81/46
See application file for complete search history.

(56) References Cited

U.S. PATENT DOCUMENTS

| | | | | |
|---|---|---|---|---|
| 176,333 A | | 4/1876 | McWilliams | |
| 3,939,546 A | | 2/1976 | Hernandez | |
| 4,683,631 A | | 8/1987 | Dobbertin | |
| 5,248,127 A | * | 9/1993 | Young | 254/15 |
| 5,527,014 A | * | 6/1996 | Bracewell | 254/15 |
| 6,962,179 B1 | * | 11/2005 | Brodersen | 144/270 |
| 2005/0155204 A1 | * | 7/2005 | Mikkelsen | 29/278 |

FOREIGN PATENT DOCUMENTS

| | | |
|---|---|---|
| DE | 196 19 753 | 11/1997 |
| DE | 196 19 753 A1 | 11/1997 |
| DE | 298 12 371 | 2/1999 |
| DE | 298 12 371 U1 | 2/1999 |

* cited by examiner

*Primary Examiner*—Lee D. Wilson
(74) *Attorney, Agent, or Firm*—Harness, Dickey & Pierce, P.L.C.

(57) ABSTRACT

A tool for installing a floor element is provided for pushing a floor element against already fixated floor elements prior to the fixation of the floor element. The tool includes a cushion with a first rod-shaped part extending upwardly from an upper side of the cushion and a second rod-shaped part forming a striking tool at a free end thereof. The two rod-shaped parts are hinged to each other so that the striking tool strikes against the cushion by movement of one of the rod-shaped parts relative to the other rod-shaped part. As the cushion has a side surface which is suitable for resting against a side surface of the floor element, the striking of the striking tool against the cushion transfer a striking force through the cushion to the floor element.

17 Claims, 5 Drawing Sheets

Figure 3:
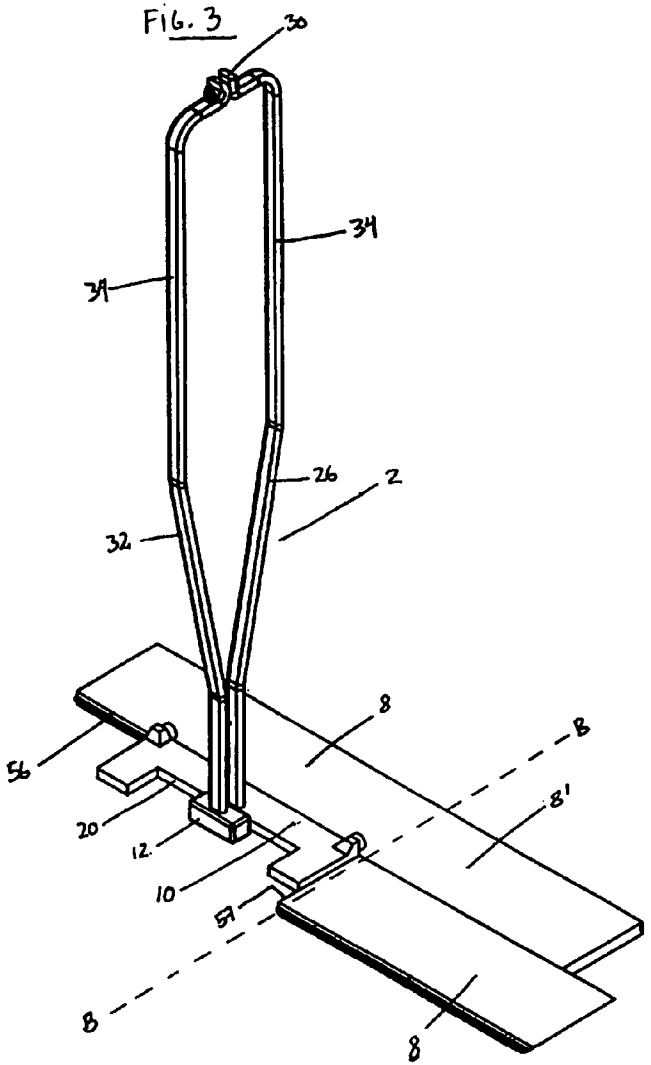

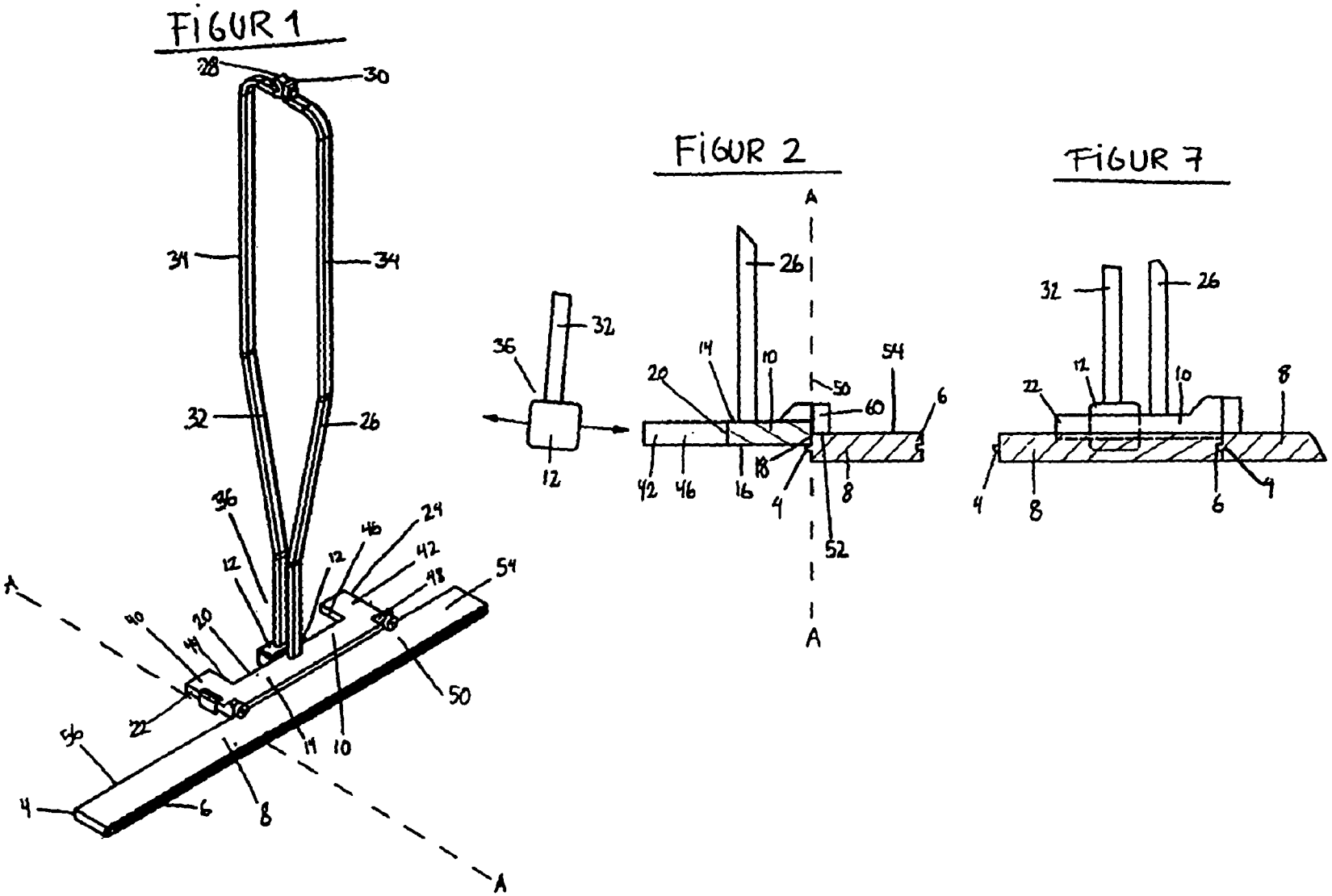
FIGUR 1
FIGUR 2
FIGUR 7

TOOL FOR USE WHEN LAYING DOWN FLOOR ELEMENTS WITH TONGUE AND GROOVE JOINTS

The present invention concerns a tool for use when putting down floor elements, primarily with groove and tongue joints, typically parquet flooring elements, which comprises a cushion and a striking tool.

The work of putting down floors consisting of floor elements with the mentioned groove and tongue joints is rather straining for the person(s) doing this work, as it involves uncomfortable working postures. The work is usually done by means of a hammer and a cushion, typically a wooden block, which is supported on the free side edge of the parquet, after which the tongue is fitted into the groove by means of strokes on the wooden block with the hammer. The person fitting the tongue into the groove thus has to work in a bent forward posture, often sitting on his knees, which in itself is a straining working posture, with bent back and the hands close to each other, which is very straining. It has also turned out that persons, who have been doing this job for a number of years, find themselves another job because of attrition, mainly of the back. Further, the job is difficult and slow, as, when joining the groove and tongue of a floor element, the person has to move along the long side of each floor element, typically on his knees, carrying the cushion and the hammer, to join the groove and tongue along the whole length of the floor element.

Here, it must be stated that, in the following, the words floor element refer to the widest sense of the words, but typically parquet floor elements or floor boards are concerned, whose one long side comprises a tongue and whose other long side comprises a matching groove path. Further, a cushion means a base, a wooden block or the like, which is placed on the free long side of the floor element, opposite the side, whose tongue is to engage with the groove of a neighbouring floor element, and by means of which the groove is fitted on the tongue with the hammer. The purpose of the cushion is to protect the groove/tongue against damage during fitting with the hammer.

U.S. Pat. No. 3,939,546 discloses a tool for use in connection with putting down floor elements/boards with groove and tongue joints. This tool comprises an L-shaped metal beam, a piece of wood being fixed to said beam by means of screws, said piece of wood being the cushion, and additionally the weight being the striking tool, the L-shaped beam further comprising a handle with hinged joint, so that a person in a slightly bent forward posture can perform the fitting of the groove and tongue joint of a floor element by guiding the handle back and forth, similar to the movement performed when handling a broom. To some extent this tool solves the problem of the uncomfortable working postures when putting down floors of the kind mentioned, but it is heavy in handling, and its design causes that it is hardly used in connection with the parallel displacement of floor elements, whose groove and tongue joints have already been fitted.

U.S. Pat. No. 4,683,631 discloses a striking tool having a handle with a hinged joint for use when putting down floor elements of the kind mentioned, which are placed on joists, the width of a projection of the striking tool corresponding to the width of a joist, so that the striking tool rides on the joist when fitting the groove and tongue joints, by performing a forth and back movement of the striking tool against the side of the floor element, whose groove is to engage the tongue of a neighbouring floor element. This tool is not either suited for performing a parallel displacement of floor elements, whose groove and tongue joints have been fitted in each other.

Common for the known tools is further that they offer an improvement of the working posture during the joining of the floor elements, but the use of the tools is, however, conditioned by a forth and back movement in a bent forward working posture, and mainly the back movement will cause a hard strain of the underarms and shoulders of the person doing this work. Further, these tools merely enable working in one certain working posture, which is unfortunate from an ergonomic point of view.

Thus, it is the purpose of the present invention to provide a tool of the kind mentioned, which enables performing the work of fitting groove and tongue joints in floor elements under suitable ergonomic conditions, and which also permits operation from all sides.

This purpose is obtained by a tool, which is characterised in that the cushion is a flat, plane workpiece comprising an upper side and a lower side, a first rectilinear resting long side and a second strikeing long side extending in parallel with said first side, and two relatively short end faces extending in parallel and substantially perpendicular to the long sides, the upper side comprising a vertical first rod-shaped part comprising a catching area or a handle, from which the striking tool can be activated for generating a directional kinetic energy (stroke effect), which is transferred to the resting long side or the end faces via the cushion.

Thus, it is achieved that the work of fitting groove and tongue joints, when using the tool according to the invention, can be performed by a person, who is standing upright, and who is not supposed to perform wry pulls or pushes, which affect arms and back in an unsuitable way.

In a first embodiment of the tool, the upper free end of the vertical first rod-shaped part projecting from the upper side can be supported via a hinged joint in a pendulous second rod-shaped part, whose length corresponds substantially to the length of the first rod-shaped part, the first and the second rod-shaped part, respectively, comprising a catching area or a handle, a striking tool being fixed to the free end of the second rod-shaped part, said striking tool being swingable at least across the other striking long side for striking against it.

Thus, it is achieved that, when lifting the handle or the catching areas of the rod-shaped parts, the cushion can be placed with the resting long side resting against the element, whose tongue has to be fitted into the groove of a neighbouring floor element, after which the second rod-shaped part, and thus the striking tool, is swung out from the striking long side and struck against it, the cushion fitting the groove onto the tongue. Thus, the hinged joint carries both the second rod-shaped part and the striking tool at the end of it, which means that swinging the striking tool does not require a particularly large force effect by the person performing the work, as this corresponds to making a pendulum swing, the gravitation force on the hammer helping to provoke the striking effect on the striking long side of the cushion. Both placing the tool and performing the swinging of the striking tool can be activated by a standing person, and from the side of the tool that fits the user best in the given situation, which involves that the working posture is the most suitable at all with regard to ergonomics. Further, it will be extremely easy to displace the resting side of the cushion along the side edge of the floor element for fitting the groove and tongue joint over the whole extension of the floor element.

In certain cases it will be desirable to perform a parallel displacement of floor elements, which have already been put down, when the groove and tongue joints have been brought to engage mutually, which requires the use of a striking tool for influencing the end face of the floor element to be displaced in a parallel direction. With the purpose of making the tool useful also in this working situation, the end faces can be one side of sections projecting from the second striking long side at either end of the cushion, said sections comprising opposite faces extending in parallel with the end faces, the hinged joint being pivotally mounted on the upper free end of the first rod-shaped part, the striking tool at the end of the second rod-shaped part further becoming pivotal to striking against the opposite faces of the sections.

Thus, it is achieved that the tool will also be useful for parallel displacement of floor elements, whose groove and tongue joints have been brought to mutual engagement, by making one of the end faces of the cushion rest on the end face of the floor element concerned, and subsequently making the second rod-shaped part swing to striking against the opposite end striking side, the floor element being moved in parallel with the floor element, whose groove and tongue joint it engages.

With the purpose of having full flexibility with regard to performing swinging of the second rod-shaped part, the hinged joint can be made as a ball joint or a flexible stalk connection.

In a special embodiment of the tool according to the invention, the striking tool is mechanically driven, in that the cushion further comprises a mechanical, electrically or pneumatically driven striking tool, activated from an operating panel at the handle or catching area and meant for generating a directional kinetic energy (stroke effect), which is transferred to the resting long side or the end faces by the cushion.

Thus, a tool is achieved, which can join groove and tongue joints, simply by handling the tool at the upright, rod-shaped part, so that the resting side of said part is brought to rest with a relevant side edge on a floor element, after which the striking tool is activated by means of the operating panel to acting upon the cushion, kinetic energy being transferred to the floor element, whose groove is pressed onto the tongue of the side edge of a floor element, which has already been put down. In this connection, it must be observed that the mechanical striking tool can be driven by both an external energy source, such as a current source or a pressure air source, or by an air cartridge.

In order to avoid that the user of the tool has to perform many lifts of the tool when moving it along the side edge of the floor elements, whose groove and tongue joints have to be joined, the cushion can, at least in the area of the end faces, comprise a section, which extends from and across the vertical plan of the resting long side, whose side facing the lower side of the cushion forms a supporting face, on which the tool is supported on the upward face of the floor element, whose tongue is to be joined with a floor element that has already been put down, or a floor element that has already been put down with the resting long side completely or partly resting on the side edge of the floor element.

Thus, it is achieved that the tool rests on the upward side face of a relevant floor element, and can be moved by being pulled across same, with the resting face(s) resting on a relevant side edge of a floor element.

With the purpose of permitting the resting face between the resting side of the cushion and a relevant side edge of a floor element to be as large and suitable as possible, the projecting sections can be supported in upright elements/parts projecting from the upper side of the cushion.

In order to further facilitate the displacement of the tool, the sections can advantageously be in the form of supporting rollers, whose shafts are supported in upright elements/parts projecting from the upper side of the cushion.

This involves a substantial facilitation of the use of the tool, as it will be very easily displaceable on the supporting rollers, which are resting on the upper side of a relevant floor element. Lifting the tool in connection with its use will thus be almost dispensable, as the tool can be driven on the surfaces of the floor elements to the correct position, where the striking tool is activated.

Floor elements of the kind mentioned might have different thickness, and therefore the tongue can be placed at different distances from the upward surface of the floor element. It is obvious that it will be most expedient for the resting face between the floor element and the resting side of the cushion to be as large as possible, as this will distribute the striking energy on the largest area possible (in order to avoid damaging the side edges of the floor element), and also in certain cases to avoid that the resting face of the of the cushion rests on the tongue when joining the groove and tongue joint.

With the purpose of optimising the resting of the resting face against relevant side faces of a relevant floor element, the tool can be designed so that the distance between the bottom side of the cushion and the side of the section facing the bottom side is adjustable.

Thus, it is achieved that the width/height of the part of the resting face of the cushion, which is resting on the floor element, can be adjusted, so that the largest possible resting face is achieved, and further, the width can be adjusted so that the resting face of the cushion does not touch the tongue during joining of the groove and tongue joints.

A more simple, but quite applicable embodiment of the projecting section on the resting face of the cushion can be made by means of a recess in the resting long side. This causes, however, that the resting area cannot be adjusted, but when selecting a suitable height of the recess, the tool can, with this embodiment, be used for the most commonly used types of floor elements of the kind mentioned.

The handles or the catching areas can be designed in numerous ways, if only they are designed so that the user of the tool will not get his hands or fingers squeezed when during the use. In the following are listed examples of a couple of embodiments of the handles or catching area, which are, however, not to be regarded as limitations to the invention.

The handles or catching areas can thus be strap-shaped handles, which are fixed on the sides facing away, of the first rod-shaped part or the second rod-shaped part, respectively.

Alternatively, the handles or catching areas on the first rod-shaped part can be made by means of a parallel displacement, and the handle or catching area on the second rod-shaped part can also be made by a parallel displacement of said second rod shaped part, being substantially identical, but laterally reversed in relation to the parallel displacement on the first rod-shaped part.

Further, the parallel displacements can be finished by angle rotation of the ends facing the hinged joint.

In spite of the fact that the ears of the user are located further away from the resting long side and the striking long side when using the tool according to the invention compared to the use of the traditional tools (hammer and wooden block),—working with the tool according to the invention might bee very noisy, which is inexpedient when considering working environmental conditions.

With the purpose of reducing the noise emission when using the tool according to the invention, the sides of the striking tool, which during use, brought to strike on the striking long side of the cushion and/or the facing side edges of the projecting sections at the ends of the cushion, can be made of a noise-reducing material, or be coated with such a material.

Hereby is achieved the same effect as the use of a rubber hammer, which practically emits no noise, when striking against a surface, and the noise emission during the use of the tool will be even very limited.

With the purpose of making the tool easy to transport, and at the same time permitting the use of rod-shaped parts with different lengths, the first rod-shaped part can, in a manner known per se, be detachably fixed to the upper side of the cushion.

Thus, it is achieved that the tool can be disassembled for transport, so that it requires less space.

With the purpose of enabling the use of different types of striking tools in connection with the tool, the striking tool can, in a manner known per se, be detachably fixed to the free end of the second rod-shaped part.

This provides flexibility when selecting, for example, the weight of the striking tool to be used with the tool, which can be of importance when putting down different types of floor elements.

With the purpose of enabling further disassembling of the tool according to the invention for transport, or of enabling replacement of the hinged joint by, for example, a controlling hinged joint, the hinged joint can be detachably fixed to the first rod-shaped part and/or detachably fixed to the second rod-shaped part.

With the purpose of making the tool even further suited for transport, the first rod-shaped part and the second rod-shaped part can be axially telescopic, and fixable in at least the completely extended and in the completely retracted positions.

Thus, it is achieved that the rod-shaped parts can be retracted to lengths, which substantially correspond to the length of the cushion, and the individual parts can now be placed in a tool bag/case made for the tool with supports matching the parts making up the tool.

Further, it must be stated that the rod-shaped parts can also be divided in sections, which also applies for embodiments comprising the axial retraction.

In connection with the placing and joining of groove and tongue joints along outer walls, there will be no room for placing the tool between the wall and the side edge to be joined. This problem is solved by an additional preferred embodiment of the tool, which then comprises a fitting fixed in the cushion, at least at one of the end faces, said fitting being displaceable and lockable in an active extreme position, where the lower end of the fitting projects somewhat from the lower side of the cushion, and a passive extreme position, where the lower end of the fitting is positioned in a level over the upper side of the cushion, respectively. The advantage of this is that it becomes possible to use the tool according to the invention to "pull" the groove and tongue joint into its right place by placing the tool with the relevant end face with the fitting projecting from the lower side of the cushion in such a way that the side of the fitting rests on the relevant side of the floor element and then activating the striking tool by striking on the opposite side of the projecting section. Thus, kinetic energy is transferred to the relevant side of the floor element, whose groove and tongue joint is then joined.

In case that the tool is to be used for a parallel displacement operation, the fitting can be displaced to the passive extreme position, where it is arranged outside the end faces.

Further, it can be imagined that the fitting is made as an accessory for the tool according to the invention, and is therefore detachably fixed to the cushion, so that it can be mounted or dismounted on need.

Figure 4:
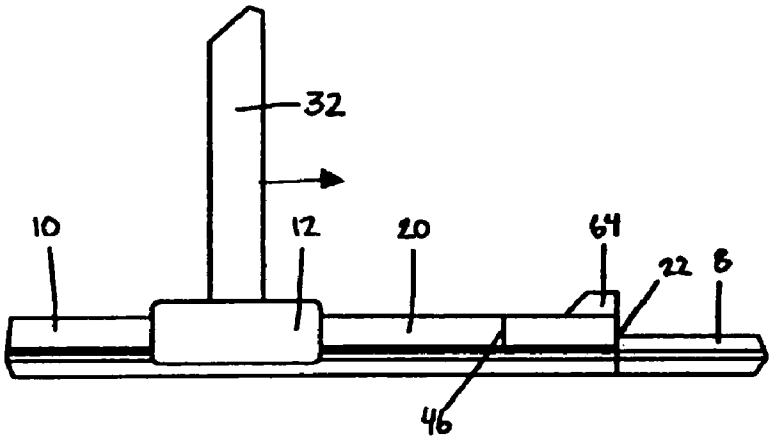
Figure 5:
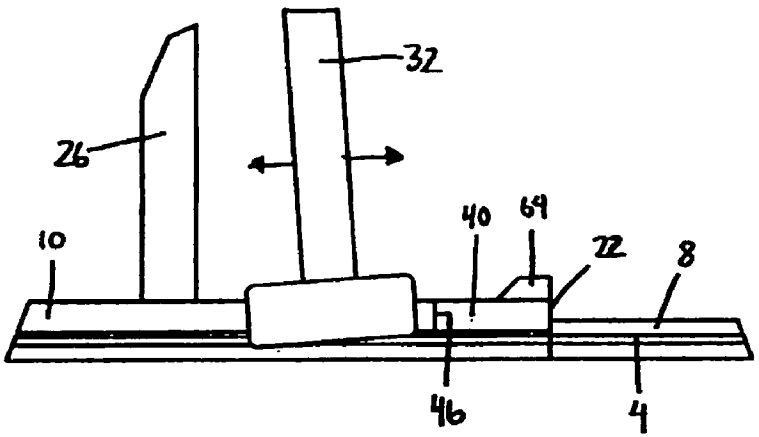
Figure 6:
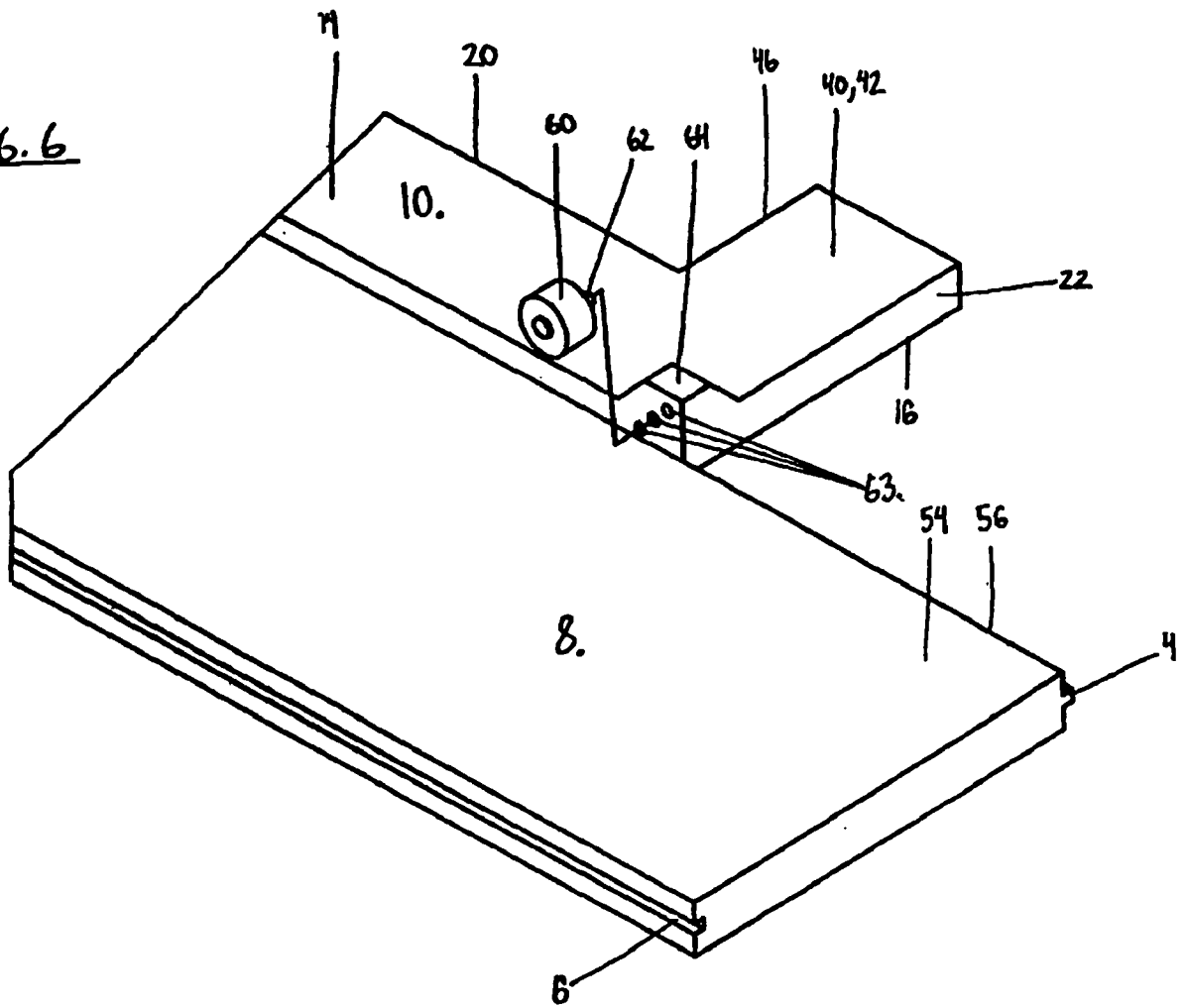
Figure 8:
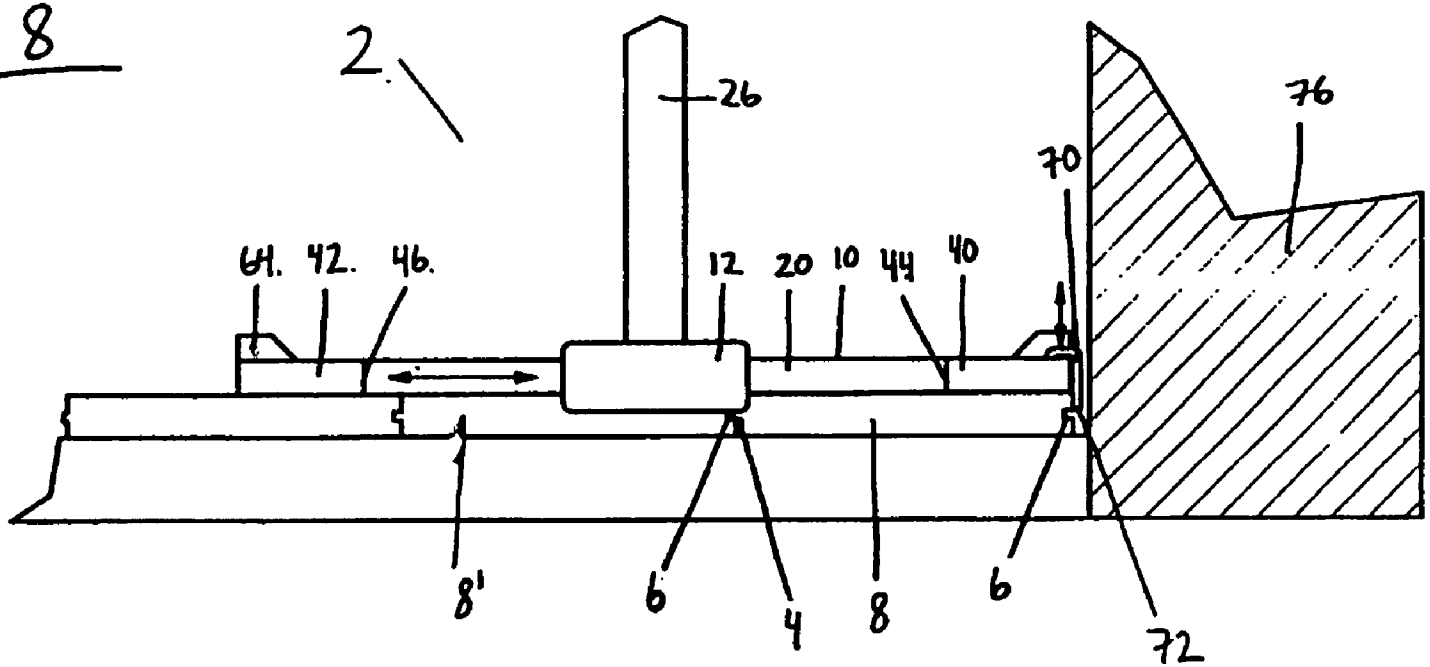

In the following, the invention is explained in detail with reference to the drawings, showing:

FIG. 1 a perspective view of a tool according to the invention for use when putting down floor elements, FIG. 2 a side view of a section along the line A—A in FIG. 1, FIG. 3 a perspective view of the tool according to FIG. 1 during parallel displacement of a floor element, FIG. 4 a detail section according to FIG. 3, FIG. 5 a further detail section according to FIG. 3, FIG. 6 a detail section of the tool according to the invention, FIG. 7 a sectional view along the line B—B in FIG. 3, FIG. 8 a side view of an embodiment of the tool comprising a fitting for "pulling".

FIGS. 1 to 7 show a preferred embodiment of the tool 2 according to the invention, for use when joining floor elements 8, which comprise a tongue 4 on one long side edge and a longitudinal groove 6 on the other long side edge, as sketched in FIG. 1 and shown clearly in FIG. 6.

The tool 2 comprises a cushion 10 consisting of a flat, plane workpiece made of a suitable material, with a substantially rectangular basic shape, said workpiece having an upper side 14 and a lower side 16, a rectilinear resting long side 18, a parallel extending second striking long side 20, and two parallel extending, shorter end faces 22, 24. On the upper side 14 of the cushion is arranged a first upright rod-shaped part 26 with a parallel offset handle or catching area 34, on whose upper free end 28, via a hinged joint 30, is supported a pendulous second rod-shaped part 32, whose length substantially corresponds to the length of the first rod-shaped part 26, and which also comprises a parallel offset handle or catching area 34'. In the pendulous end 36 of the second rod-shaped part 32 is fixed a striking tool 12, which is, via the hinged joint 30, pivotable at least across the second striking long side 20 to strike against said side 20. In the embodiment shown, the striking tool 12 is a hammer head, but it could also be a "dead" hammer comprising a sand filling or another damping material.

In an embodiment not shown, the handles or catching areas 34, 34' can be strap-shaped handles, which are fixed on the sides facing away, of the first rod-shaped part or the second rod-shaped part, respectively.

As can be seen, the end faces 22, 24 form one side of sections 40, 42 projecting from the striking long side 20, in both ends of the cushion, said sections comprising sides 44, 46 opposite to and extending in parallel with the end faces 22, 24.

The fact that the hinged joint 30 is further pivotally supported on the upper free end 28 of the first rod-shaped part 26, makes the striking tool at the end of the second rod-shaped part 32 pivotal to striking against the opposite sides 44, 46 of the sections 40, 42, see FIGS. 4 and 5.

As appears from FIG. 1 and others, the tool 2 comprises, in the area of the end faces 22, 24, a section 48 projecting from and across the vertical plan 50 of the resting long side 18. The side 52 of the section facing the lower side 16 of the cushion forms a supporting face, on which the tool 2 rests on the upward surface 54 of a relevant floor element 8, or a floor element 8 already put down, with the resting long side 18, or an end face 22, 24 resting on a relevant side edge 56 of the floor element 8.

As appears from the embodiment of the invention according to FIGS. 1 to 6, the sections 48 are formed by supporting rollers 60, which project from and across the vertical plan 50 of the resting long side 18. The lower side 52 of the rollers forms a resting surface, on which the tool 2 is supported on the upward surface 54 of a relevant floor element 8, or a floor element already put down, with the resting long side 18, or an end face 22, 24 resting on a relevant side edge 56 of the floor element.

As shown most clearly in FIG. 6, the shafts 62 of the supporting rollers 60 are supported in holes 63 in an upright section/element 64 projecting from the upper side 14 of the cushion 10. The holes 63 are arranged over each other, and the distance between the lower side 52 of the supporting rollers 60 and the lower side 16 of the cushion thus becomes adjustable in steps, meaning that the height of the part of the resting long side 18, which is resting on a relevant side edge 56 of a floor element 8 becomes adjustable in steps.

By selecting a suitable distance between the holes 63, a distance between the lower side 52 of the supporting rollers 60 and the lower side 16 of the cushion 10, which substantially corresponds to the distance between the upper side 54 and the upward side 3 of the tongue 4 of a given floor element 8, cf. FIG. 2 can be achieved. This means that it will be possible to choose a distance, which at the same time causes that during joining of the groove and tongue joints on the floor elements 8 in question, the resting long side gets the largest possible resting surface on the relevant side edge 56, and that the tongue 4 is not affected/touched at all.

It must be stated that the distance between the lower side 52 of the supporting rollers 60 and the lower side 16 of the cushion 10 can be made adjustable in steps, in a manner known per se, by making the upright section 64 extending from the upper side 14 of the cushion 10 as a vertically displaceable and detachably fixed section, in which the shafts of the supporting rollers 62 are supported.

Further, it must be stated that the inventor has recognised that the projecting section 48 can be designed in many other ways than described above, for example, the section can be formed by a longitudinal recess in the resting long side 18.

The tool 2 is used for fitting the groove 6 over the tongue 4 in the respectively facing sides of two neighbouring floor elements 8 by placing the tool 2 with the supporting rollers resting on the upper side 54 of the floor element 8, cf. FIG. 2, and with the resting long side 18 resting on the relevant side edge 56 of the floor element 8, whose opposite side with the groove 6 is placed to face the tongue 4 in a floor element that has already been put down.

Joining the groove 6 and the tongue 4 then takes place by swinging the second rod-shaped part 32 and thus the striking tool 12, as suggested in FIG. 2, by activation from the handle 34 or the catching area 34' from the striking long side 20, and then swinging the rod-shaped part 32 against the striking long side 20, the inertia from the stroke/force effect propagating via the cushion 10 and the resting long side 18 to become a force influencing the floor element 8, thus forcing the groove 6 onto the tongue 4. The striking procedure is continued along the long side of the floor element by displacing the tool 2 along the relevant side edge 56 of the floor element on the supporting rollers 60 resting on the upper surface 54 of the relevant floor element, until the tongue 4 has been adopted by the groove 6 over the whole length of the floor element.

In certain situations, it may be necessary to perform a parallel displacement of a floor element 8, whose groove 6 has already adopted the tongue 4 of a floor element 8', which has already been put down. This is possible by placing the tool 2 as described above on the floor element 8', which has already been put down (cf. FIGS. 3 and 7), with the end face 22, 24 of the tool 2 resting on the end edge 57 of the floor element to be displaced in a parallel direction. The second rod-shaped part 26, and thus the striking tool 12, are brought to swing in parallel with the striking long side 20 of the cushion to striking against the relevant side edge 44, 46 of the sections 40, 42, the inertia of the stroke/force effect propagating via the cushion 10 and the resting long side 22, 24 to become a force effect on the floor element 8, which is thus displaced in a parallel direction to the adjacent floor element.

With the purpose of reducing the noise emission from the tool during use, the sides of the striking tool, which are brought to striking on relevant sides of the cushion 10, and or the mentioned relevant sides, that is, the striking long side 20 and the sides 44, 46 of the sections 40, 42 facing the striking long side, can be made of a noise reducing material or coated with such a material.

As can be seen from FIG. 1 and others, the tool 2 can be used from all sides, depending on the users wishes and the physical conditions ruling, where the floor elements are to be put down, and in such a way that the person doing the work can maintain an upright posture, which is the most suitable ergonomic working posture.

In order to make the tool 2 according to the invention easy to transport, one embodiment provides that the tool can be disassembled, for example, the first rod-shaped part 26 can, in a manner known per se (not shown) be detachably fixed to the upper side of the cushion 10. Further, the striking tool 12 can, also in a manner known per se (not shown) be detachably fixed to the free end 36 of the second rod-shaped part 32.

Further, the hinged joint 30 can be detachably fixed (not shown) to the first rod-shaped part 26 and/or detachably fixed to the second rod-shaped part 32.

Further, the first rod-shaped part 26 and the second rod-shaped part 32 can be axially telescopic, and fixable in at least the completely extended position and in the completely retracted position. This gives a tool, which can be easily packed, stored and transported in a case or the like, in the same manner as an ordinary tool.

In another preferred embodiment, not shown, in which the cushion 10 is a flat, plane workpiece comprising an upper side 14 and a lower side 16, a first rectilinear resting long side 18 and a second striking long side 20 extending in parallel with the side 18, and two mainly short, parallel end faces 22, 24, oriented substantially perpendicularly to the long sides 18, 20, the upper side 14 comprising an upright first rod-shaped part 26 with a handle or a catching area 34, the cushion 10 further comprising a mechanical, electrically or pneumatically driven striking tool, which can be activated from the handle or catching area, to generate a directional kinetic energy (stroke effect), which is transferred via the cushion to the resting long side 18 or the end faces 22, 24, a very sophisticated tool is achieved, which does not require substantial physical efforts by the person doing the work of joining the groove and tongue joints of the floor elements.

FIG. 8 shows a preferred embodiment of the tool 2 according to the invention, for use when "pulling" floor elements 8 placed along an outer wall 76. This tool 2 is specific in comprising that, to at least one end face 22, 24 of the cushion 10, is fixed a fitting 70, which is displaceable and lockable in an active extreme position, in which the lower end 72 of the fitting projects somewhat from the lower side 16 of the cushion (see FIG. 8), and a passive extreme position, in which the lower end 72 is positioned in a level over the upper side 14 of the cushion 10 (not shown), respectively.

Thus, as shown in FIG. 8, it becomes possible to "pull" the groove and tongue joint of a floor element 8 along an outer wall 76 to its place by making the lower end 72 of the fitting 70 rest on the relevant side edge 56 of a floor element, after which the striking tool is activated to striking against the opposite side 46 of the section 40, kinetic energy being transferred via the cushion and the fitting 70 to the floor element 8, so that the tongue 4 of this floor element 8 is "pulled" into the groove 6 of the floor element 8' already put down.

Finally, it must be stated that the inventor has recognised that the tool according to the invention can have other embodiments than shown in the drawing and described above, but this does not change the inventive aspect, which is characterised in providing a cushion having an upright rod connected by means of a hinged joint with a pivotally mounted rod provided with a striking tool, which a person can make perform a sort of pendulum movement to strike on the cushion during joining of groove and tongue joints in floor elements, said person having an upright posture.

The invention claimed is:

1. A tool for putting down floor elements, with groove and tongue joints, comprising:

a cushion, and a striking tool, the cushion includes an upper side and a lower side, a first rectilinear resting long side and an opposite second striking long side the upper side includes an upward projecting first rod-shaped part, which is connected to a second rod-shaped part in a hinged joint, the second rod-shaped part including a free end portion forming the striking tool, the rod shaped parts being formed to enable striking of the striking tool against the cushion by movement of the first rod-shaped part relative to the second rod-shaped part.

2. The tool according to claim 1, wherein a length of the second rod-shaped part corresponds substantially to a length of the first rod-shaped part.

3. The tool according to claim 1, wherein the hinged joint is adapted to make the second rod-shaped part rotational in all directions relative to the first rod-shaped part.

4. The tool according to claim 1, wherein the tool comprises at least one crosswise section which extends from a vertical plan of the resting long side, a side of the crosswise section facing in a downward direction to form a supporting face on which the tool is adapted to be supported on an upward face of a floor element.

5. The tool according to claim 4, wherein each crosswise section is supported in an upright element which projects from the upper side of the cushion.

6. The tool according to claim 5, wherein each crosswise section is formed by supporting rollers adapted for rotation around a shaft which is supported in the upright elements.

7. The tool according to claim 4, wherein each crosswise section is formed by a longitudinal recess in the resting long side.

8. The tool according to claim 1, wherein sides of the striking tool, which, during use strikes against the striking long side of the cushion, are made of a noise reducing material or coated with such a material.

9. The tool according to claim 1, wherein the rod-shaped parts are formed with strap-shaped handles.

10. The tool according to claim 1, wherein the first rod-shaped part is detachably fixed to the upper side of the cushion.

11. The tool according to claim 1, wherein the striking tool is detachably fixed to the free end of the second rod-shaped part.

12. The tool according to claim 1, wherein the hinged joint is detachably fixed to at least one of the first rod-shaped part and the second rod-shaped part.

13. The tool according to claim 1, wherein the first rod-shaped part and the second rod-shaped part are axially telescopically extendable and retractable, and adapted to be locked in at least a completely extended position and in a completely retracted positions.

14. A tool according to claim 1, wherein the first and second long sides are parallel and the cushion comprises two relatively short end faces extending in parallel and substantially perpendicular to the first and second long sides.

15. The tool according to claim 14, wherein the end frames having a length which is longer than a distance between the first and second long sides.

16. The tool according to claim 14, wherein the striking tool, which during use, strikes against the opposite face of one of the section of the cushion for parallel displacement of floor elements.

17. The tool according to claim 14, wherein the end faces form one side of sections projecting from the second striking long side at either end of the cushion, said sections comprising opposite faces extending in parallel with the end faces, the hinged joint being pivotally supported on the upper free end of the first rod-shaped part, the striking tool at the end of the second rod-shaped part further becoming pivotally to striking against the opposite faces of the sections.

* * * * *